US007089771B2

(12) United States Patent
Mucke et al.

(10) Patent No.: US 7,089,771 B2
(45) Date of Patent: Aug. 15, 2006

(54) METHOD AND STRIP PROCESSING LINE, ESPECIALLY A STRIP ROLLING MILL TRAIN OR STRIP ROLLING MILL STAND FOR PREVENTING BAND STICKING DURING WINDING

(75) Inventors: Gert Mucke, Hilden (DE); Paul-Dieter Putz, Erkrath (DE); Eberhard Neuschutz, Ratingen (DE)

(73) Assignee: BFI VDeh—Institut fur angewandte Forschung GmbH, Düsseldorf (DE)

( * ) Notice: Subject to any disclaimer, the term of this patent is extended or adjusted under 35 U.S.C. 154(b) by 30 days.

(21) Appl. No.: 10/481,720

(22) PCT Filed: Jun. 11, 2002

(86) PCT No.: PCT/EP02/06386

§ 371 (c)(1),
(2), (4) Date: Dec. 19, 2003

(87) PCT Pub. No.: WO03/000438

PCT Pub. Date: Jan. 3, 2003

(65) Prior Publication Data

US 2004/0237616 A1 Dec. 2, 2004

(30) Foreign Application Priority Data

Jun. 23, 2001 (DE) ..... 101 30 469

(51) Int. Cl.
*B21B 37/58* (2006.01)

(52) U.S. Cl. ..... 72/10.4; 72/12.1; 72/148; 73/862.451

(58) Field of Classification Search ..... 72/10.4, 72/10.5, 10.6, 12.1, 14.4, 14.5, 148, 205; 73/159, 862.451, 862.471, 862.473, 862.474; 700/126; 242/410, 412, 416, 520, 534, 912, 242/413, 413.1
See application file for complete search history.

(56) References Cited

U.S. PATENT DOCUMENTS 2,984,431 A 5/1961 North ..... 242/75.53
3,481,194 A * 12/1969 Pervi et al. ..... 73/862.07
4,107,969 A * 8/1978 Okabe et al. ..... 72/148
4,969,609 A * 11/1990 Scheuter ..... 242/534

(Continued)

FOREIGN PATENT DOCUMENTS

FR 2 691 651 A1 12/1993

(Continued)

OTHER PUBLICATIONS

International Search Report re PCT application No. PCT/EP02/06386 dated Oct. 2, 2002.

*Primary Examiner*—Ed Tolan
(74) *Attorney, Agent, or Firm*—Cook, Alex, McFarron, Manzo, Cummings & Mehler, Ltd.

(57) ABSTRACT

In a method and a strip treatment installation, in particular a strip rolling mill train or a strip rolling stand, to avoid strip stickers, as the material is being wound up the distribution of the radial pressure exerted by the strip on the coiler drum or a winding reel is measured over the strip width, then the measured values are used to produce a reproduction of the actual local stress distribution in the strip, and this reproduction is used as a template for a set curve for controlling the strip tensile stress distribution, on the basis of which actuators of the strip treatment installation are adjusted with a view to achieving a uniform compressive stress distribution.

1 Claim, 1 Drawing Sheet

U.S. PATENT DOCUMENTS

| | | | | |
|---|---|---|---|---|
| 5,048,353 | A | 9/1991 | Justus | 73/862.55 |
| 5,629,487 | A * | 5/1997 | Mucke et al. | 73/818 |
| 5,699,729 | A * | 12/1997 | Moschel | 100/99 |
| 6,138,506 | A * | 10/2000 | Neuschutz et al. | 73/159 |
| 6,299,099 | B1 * | 10/2001 | Miller et al. | 242/529 |
| 6,430,459 | B1 * | 8/2002 | Moore | 700/122 |
| 6,648,264 | B1 * | 11/2003 | Kukizaki et al. | 242/422.5 |
| 6,668,626 | B1 * | 12/2003 | Grefve et al. | 73/104 |

FOREIGN PATENT DOCUMENTS

| | | |
|---|---|---|
| GB | 2 221 771 A | 2/1990 |

* cited by examiner

METHOD AND STRIP PROCESSING LINE, ESPECIALLY A STRIP ROLLING MILL TRAIN OR STRIP ROLLING MILL STAND FOR PREVENTING BAND STICKING DURING WINDING

CROSS-REFERENCE TO RELATED APPLICATIONS

This is a national stage under 35 USC 371 of International Application No. PCT/EP02/06386, filed Jun. 11, 2002, which claims priority from German Patent Application DE 101 30 469.2, filed Jun. 23, 2001, the contents of which is incorporated by reference in its entirety.

The invention relates to a method and a strip treatment installation, in particular strip rolling mill train or a strip rolling stand, for preventing strip stickers when material in strip form, in particular metallic strip, is being coiled on a coiler drum or a winding reel.

During the production of strip, in particular steel strip, the material is generally rolled in the cold state on strip rolling mill trains or in strip rolling stands. This densifies the microstructure of the material, generally in an undesirable way. A recrystallizing anneal is carried out after the cold-rolling in order to improve the microstructure and the material's properties. This anneal is often carried out in fixed-coil annealing furnaces in which the strip is used in the form of coils wound in fixed form. Diffusion welding often occurs between the turns of the coils during annealing in fixed-coil annealing furnaces of this type. When the strip is then unwound from the coil in a temper rolling mill after the anneal, the welds cause an increased resistance to unwinding. These welds are then known as strip stickers.

Strip stickers of this type have an adverse effect on the quality of the finished strip. For example, during unwinding in the temper rolling mill, particularly in the case of relatively thick strips, the material tears open at the strip surface. Thinner strips, on the other hand, are more likely to form kinks in the strip. Moreover, there is considerable noise when strips with strip stickers are being unwound.

This noise is a reliable indication to the operating staff that strip stickers are present. They generally occur in-about 0.5 to 10%, on average about 3 to 5%, of the production of strip annealed in coiled form. It is then attempted to reduce the damage to the strip by increasing the strip velocity or by pivoting in what is known as an anti-sticker roll and pressing it radially onto the surface of the coil in the region where the strip is coming off the coil. However, these measures are only successful with weak strip stickers in which the diffusion welding is not particularly strong. To keep the strength and number of strip stickers low, hitherto only the tensile force of the winding coiler drum has been kept as low as possible.

Despite the tensile force of the winding coiler drum being kept as low as possible, local compressive stress peaks still always occur, so that the turns are pressed too firmly onto one another at individual locations on the coil, promoting the formation of strip stickers. These compressive stress peaks result from a different tensile stress distribution over the strip width, the cause of which may be a different strip thickness profile and/or a different strip length distribution over the strip width.

In view of the above, the invention is based on the problem of providing a method and a strip treatment installation, in particular a strip rolling mill train or a strip rolling stand, in which the formation of strip stickers can be substantially avoided.

According to the invention, this problem is achieved by virtue of the fact that as the material is being wound up the distribution of the radial pressure exerted by the strip on the coiler drum is measured over the strip width, the measured values are used to produce a reproduction of the actual local stress distribution in the strip, this reproduction is used as a template for a set curve for controlling the strip tensile stress distribution, on the basis of which actuators of the strip treatment installation are adjusted with a view to achieving a uniform compressive stress distribution.

In the invention, the distribution of the radial pressure over the strip width during winding is measured, preferably continuously, and actuators of the strip treatment installation are adjusted on an ongoing basis as a function of the measured values, in such a way that the nonuniform strip length distribution is made more uniform. This results in fewer compressive stress peaks during coiling and consequently correspondingly fewer strip stickers.

Moreover, the invention also relates to a strip treatment installation, in particular a strip rolling mill train or a strip rolling stand, having at least one driven coiler drum which winds up the strip. The strip treatment installation according to the invention is characterized in that the coiler drum has a plurality of sensors for measuring the radial pressure exerted on the coiler drum by the strip. The sensors are preferably recessed into the surface of the drum facing the strip. The drum surface generally comprises a plurality of coiler traps which surround the coiler core. They serve to increase the drum diameter by spreading apart from the coiler core. The sensors may be arranged not only in the coiler traps but also in the coiler core if the core has circumferential sections on which the strip rests and these sections are large enough to accommodate the sensors. In addition, the sensors may also be arranged in winding reels onto which the strip is wound and which have been pushed over the coiler drum for this purpose.

It has proven expedient for the sensors for measuring the radial pressure to be arranged next to one another in a row parallel to the drum axis. The sensors should in this case be distributed over the entire width of the coiler drum or the winding reel which is covered by the strip. The greater the number of sensors and the shorter the distance between them, the more accurately the local pressure distribution can be measured.

Furthermore, it is recommended for the sensors for measuring the radial pressure to be arranged in a plurality of rows distributed over the circumference of the coiler drum or the winding reel. In this way, a very large number of sensors can be arranged on the coiler drum or the winding reel, and the measurement results can be improved.

The invention is explained in more detail below with reference to an exemplary embodiment illustrated in the drawing, in which.

Figure 1:
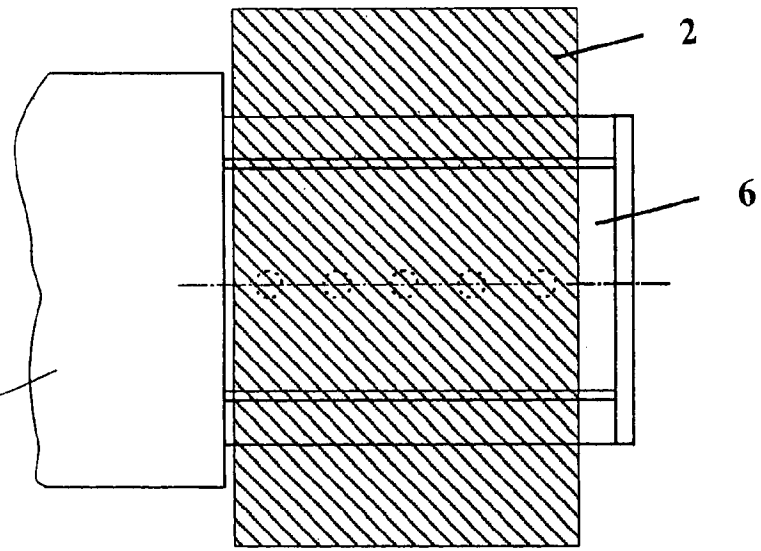
FIG. 1 shows a plan view of a coiler drum with strip wound onto it.

The coiler drum 1 illustrated in FIG. 1 belongs to a strip rolling stand (not shown). A strip has been wound onto the coiler drum 1, forming a coil 2. The innermost turn of the coil 2 rests directly on sensors 3 which are arranged in the surface of the coiler drum 1 and project slightly above this surface.

Figure 2:
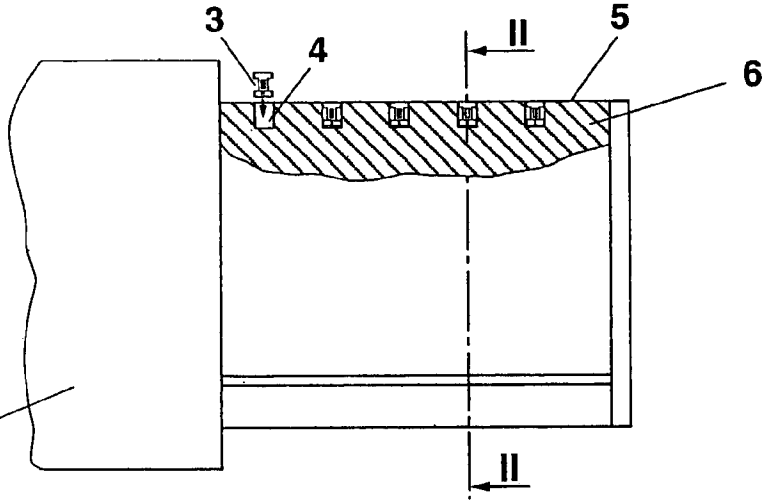
FIG. 2 shows the coiler drum shown in FIG. 1 as seen from the front, partially in section.

The arrangement of the sensors 3 is particularly clearly revealed in FIG. 2; they are located in bores 4 in the surface 5 of the coiler drum 1. The surface 5 comprises coiler traps

Figure 3:
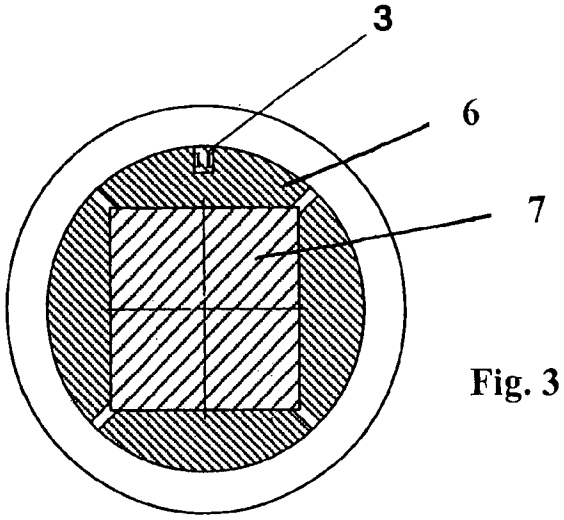
FIG. 3 shows a section on line II—II in FIG. 2.

6 which surround a coiler core 7 (FIG. 3). As the strip is being wound up, the coiler traps 6 are spread apart slightly from the coiler core 7, so that the surface 5 has a larger external diameter than that illustrated. At the end of the winding operation, the coiler traps 6 can move back into the position illustrated. The fact that the external diameter of the coiler drum 1 is then smaller allows the coil 2 to be pulled off the coiler drum.

The invention claimed is:

1. A method for avoiding strip stickers when winding material in strip form onto a coiler drum or a winding reel of a treatment installation, characterized in that as the material is being wound up the distribution of radial pressure exerted by the strip on the coiler drum (1) is measured over the strip width, the measured values are used to produce a reproduction of an actual local stress distribution in the strip, wherein said reproduction is used as a template for a set curve for controlling a strip tensile stress distribution, on the basis of which actuators of the strip treatment installation are adjusted with a view to achieving a uniform compressive stress distribution.

* * * * *